US005689945A

United States Patent [19]

Tobler et al.

[11] Patent Number: 5,689,945

[45] Date of Patent: Nov. 25, 1997

[54] DRAWING UNIT FOR A FINE-SPINNING MACHINE, IN PARTICULAR A JET-SPINNING MACHINE

[75] Inventors: Martin Tobler, Wetzikon; Reto Debrunner, Winterthur; Martin Witschi, Schaffhausen, all of Switzerland

[73] Assignee: Maschinenfabrik Rieter AG, Winterthur, Switzerland

[21] Appl. No.: 90,084

[22] PCT Filed: Nov. 16, 1992

[86] PCT No.: PCT/CH92/00226

§ 371 Date: Dec. 13, 1993

§ 102(e) Date: Dec. 13, 1993

[87] PCT Pub. No.: WO93/10291

PCT Pub. Date: May 27, 1993

[30] Foreign Application Priority Data

Nov. 21, 1991 [CH] Switzerland ..... 03 411/91

[51] Int. Cl.[6] ..... D01H 5/28; D01H 13/04

[52] U.S. Cl. ..... 57/315; 19/150; 19/288; 57/261; 57/279; 57/280; 57/328

[58] Field of Search ..... 19/287, 288, 150, 19/152, 157; 57/261, 279, 280, 315, 328

[56] References Cited

U.S. PATENT DOCUMENTS

| | | | |
|---|---|---|---|
| 4,543,776 | 10/1985 | Seiki et al. | 57/328 X |
| 4,545,193 | 10/1985 | Tanaka et al. | 57/328 X |
| 4,565,063 | 1/1986 | Stalder et al. | 57/328 |
| 4,718,225 | 1/1988 | Sanagi | 57/328 |
| 4,845,936 | 7/1989 | Artzt et al. | 57/328 X |
| 4,893,461 | 1/1990 | Artzt et al. | 57/261 |
| 4,918,913 | 4/1990 | Briner et al. | 57/261 |
| 4,922,704 | 5/1990 | Slavik et al. | 57/261 |
| 4,972,667 | 11/1990 | Oeggerli | 57/84 |
| 5,038,553 | 8/1991 | Stadler et al. | 57/97 |
| 5,090,192 | 2/1992 | Stahlecker | 57/315 X |
| 5,138,830 | 8/1992 | Stahlecker | 57/315 |
| 5,230,210 | 7/1993 | Barritt et al. | 57/333 |
| 5,313,775 | 5/1994 | Binder | 57/280 |

FOREIGN PATENT DOCUMENTS

| | | |
|---|---|---|
| 131170 A1 | 1/1985 | European Pat. Off. . |
| 0 372 255 A1 | 6/1990 | European Pat. Off. . |
| 0 421 152 A1 | 4/1991 | European Pat. Off. . |
| 0 433 832 A1 | 6/1991 | European Pat. Off. . |
| 467159 | 1/1992 | European Pat. Off. . |
| 489686 | 6/1992 | European Pat. Off. . |
| 30 25 032 A1 | 1/1982 | Germany . |
| 3706728 A1 | 9/1988 | Germany . |
| 39 32 666 A1 | 9/1990 | Germany . |
| 40 23 985 A1 | 2/1991 | Germany . |
| 42 23 956 A1 | 4/1993 | Germany . |

*Primary Examiner*—William Stryjewski

[57] ABSTRACT

An apparatus and method for guiding a broken thread end in a yarn spinning machine into a position in readiness for piecing wherein the broken thread end is retrieved from a bobbin, routed through a yarn spinning mechanism, guided into the nip of a pair of rollers of an operating drafting apparatus without abrasion of or interference with the yarn end during the guiding of the yarn end and wherein the yarn end is deposited in a position in the drafting apparatus such that the yarn end is controllably withdrawn from the drafting apparatus through the spinning mechanism and pieced or joined with a new sliver as the yarn end is withdrawn.

20 Claims, 4 Drawing Sheets

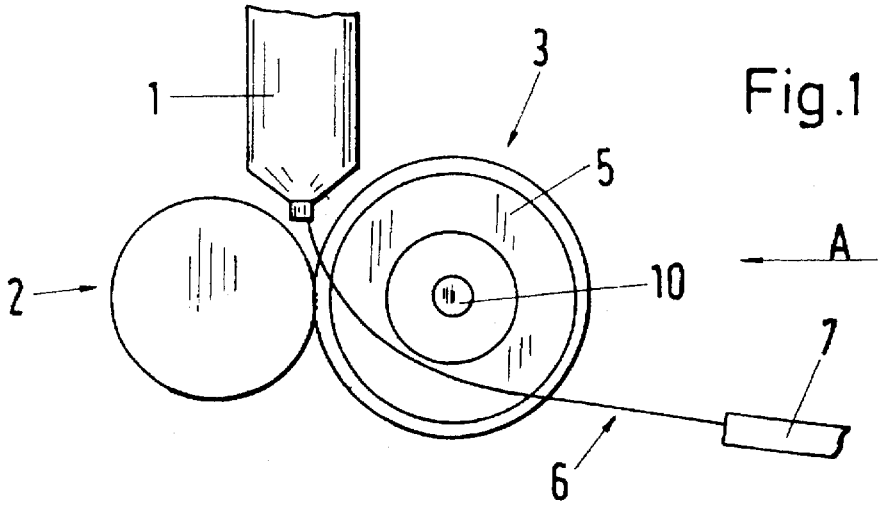
Fig.1
Fig.2
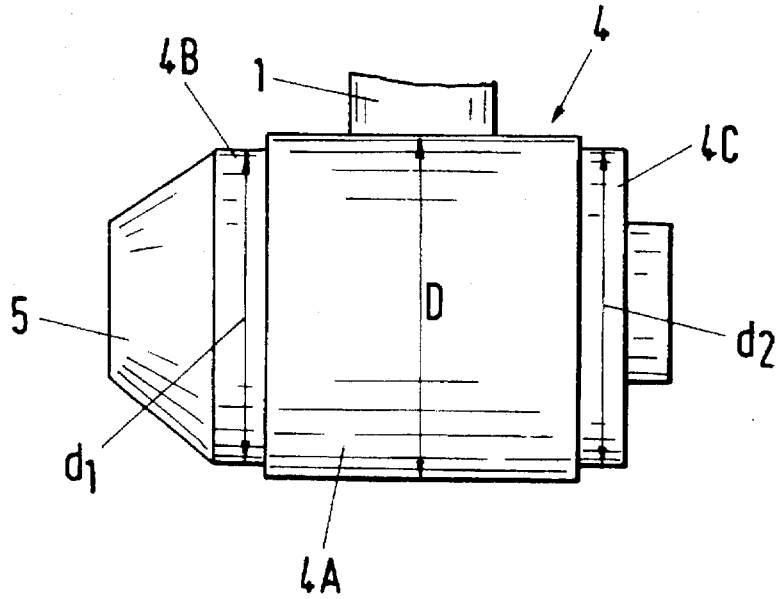
Fig.3
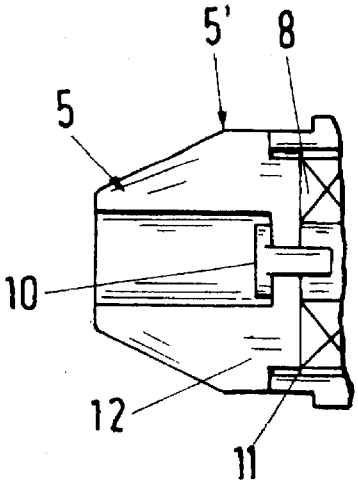

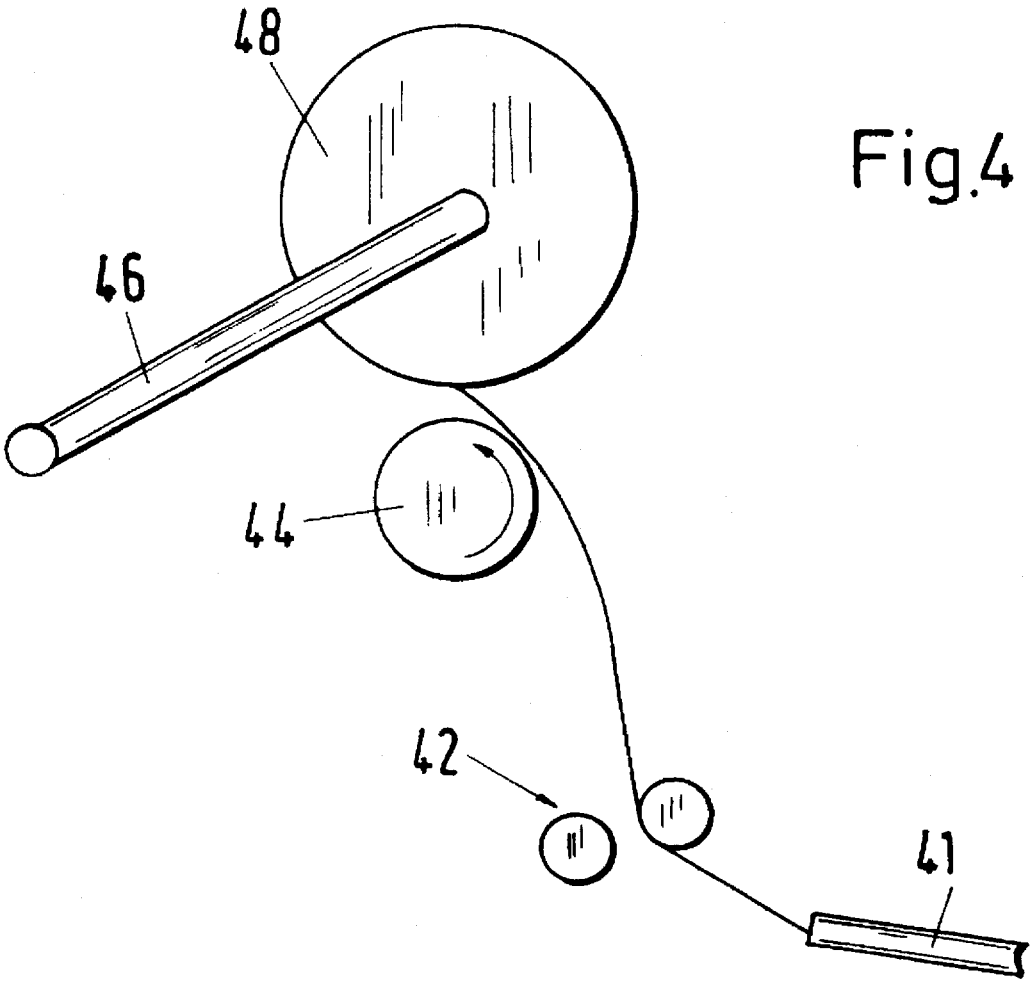
Fig.4
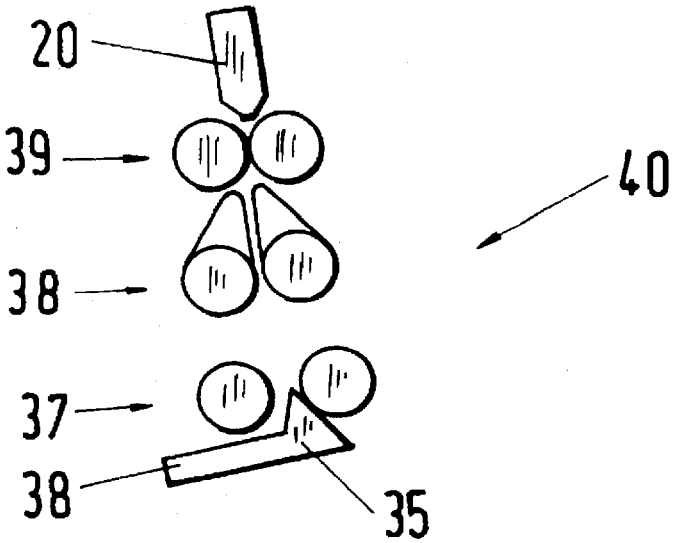

B
20
21
22
23
24
25
26
27
28
29
40
41
6
F

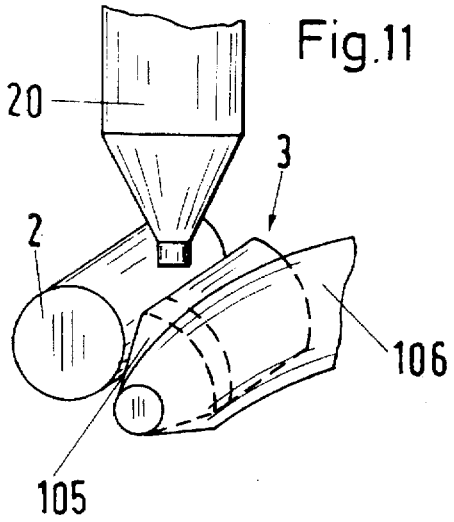
Fig.11
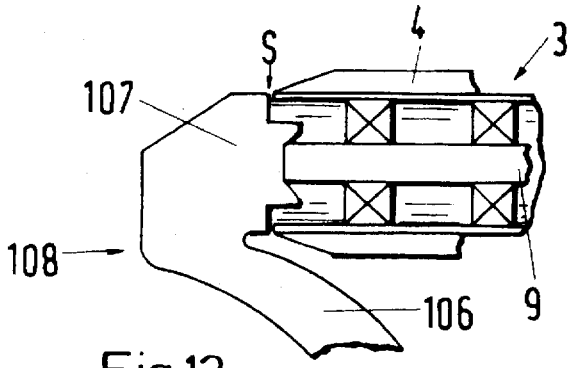
Fig.12
Fig.14
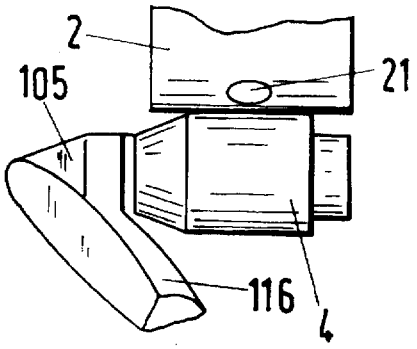
Fig.13
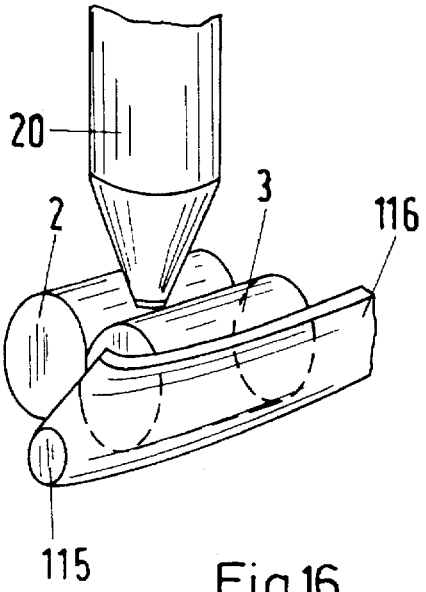
Fig.15
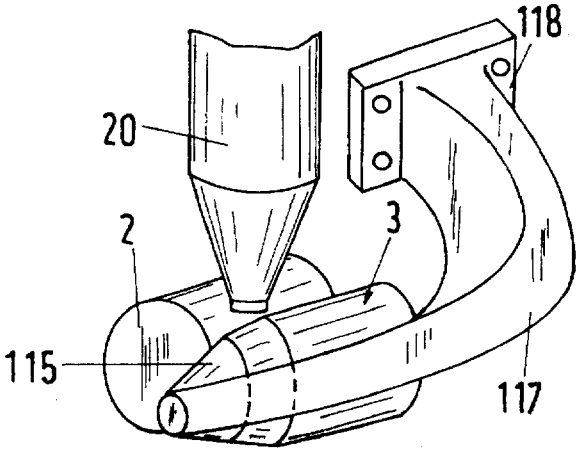
Fig.16
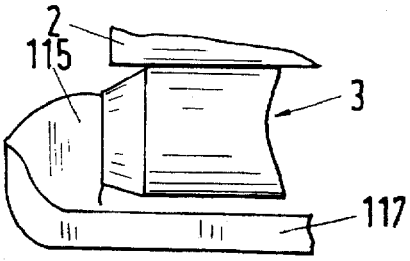

DRAWING UNIT FOR A FINE-SPINNING MACHINE, IN PARTICULAR A JET-SPINNING MACHINE

BACKGROUND OF THE INVENTION

The present invention relates to a drafting arrangement for a fine spinning frame, in particular a jet spinning machine.

STATE OF THE ART

The apron drafting systems for fine spinning frames consist of several continuous steel or bottom rollers and a drafting arm for every spinning position, to which arm the spring-loaded top rollers are attached. Such drafting arrangements are known, for example, from the book by Dr. W. Wegener "Die Streckwerke der Spinnereimaschinen" ("Drafting Arrangements of Spinning Machines" Edition 1965, Springer Verlag). An example of such a weighting arm is shown in DE-A-30 25 032. Drafting frame arrangements which were specially designed for jet spinning have been disclosed in U.S. Pat. No. 4,718,225 and U.S. 5,038,553.

During the renewed piecing to a yarn end of a broken yarn, with the yarn end being guided back, for example, through the spinning nozzles of a jet spinning machine and then guided past the drafting arrangement in the manner as is described in DE-A-37 06 728, the yarn section which is guided back is to be guided into the nip line of the rotation pair of output rollers. This so-called depositing of the yarn section should be carried out to the utmost extent in a smooth sequence, so that the yarn end is securely and timely moved to the center of the nip line of the output rollers.

In contrast to the depositing method, which is used in accordance with DE 39 32 666 for example during the piecing in a ring spinning machine, the yarn in a jet spinning machine extends through the nozzle before the depositing, which nozzle is provided with an orifice in or on the nip of the pair of delivery rollers (also known as pair of output rollers). Therefore it is very difficult to keep the yarn in a suitable standby position before the depositing without touching the one or the other rapidly rotating delivery roller. Such a contact is acceptable in ring spinning (cf. DE 39 32 666, FIG. 3). However, in jet spinning (with a substantially higher delivery speed) this is not acceptable.

It is known (e.g., according to DE GBM 18 65 440) to form a roller with conical end sections in order to reduce the lap tendency. This, however, does not have anything to do with the problems relating to renewed piecing.

SUMMARY OF THE INVENTION

The invention now has the object of improving a drafting arrangement of the type mentioned above in such a way that a secure and timely depositing of the yarn section is ensured.

The invention has the further object of improving the renewed piecing (in particular that of a jet spinning machine) with respect to the known methods.

The invention has the advantage that by using simple and inexpensive means it is achieved that the yarn can be held at a suitable standby position before the depositing, thus ensuring the secure and timely depositing of the yarn section. Further advantages arise from the description below in which the invention is outlined in greater detail by reference to the embodiments shown in the Figures, in which:

BRIEF DESCRIPTION OF THE DRAWINGS

FIG. 1 shows an arrangement of a nozzle body with respect to the output rollers of an apron drafting arrangement;

FIG. 2 shows the same arrangement as in FIG. 1 from direction A;

FIG. 3 shows a section through the pressure roller;

FIG. 4 schematically shows a spinning position (including a winder unit) of a jet spinning machine;

FIGS. 11 to 16 show three further embodiments.

DETAILED DESCRIPTION OF THE INVENTION

Figures 5, 6, 7, 8, 9, 10:
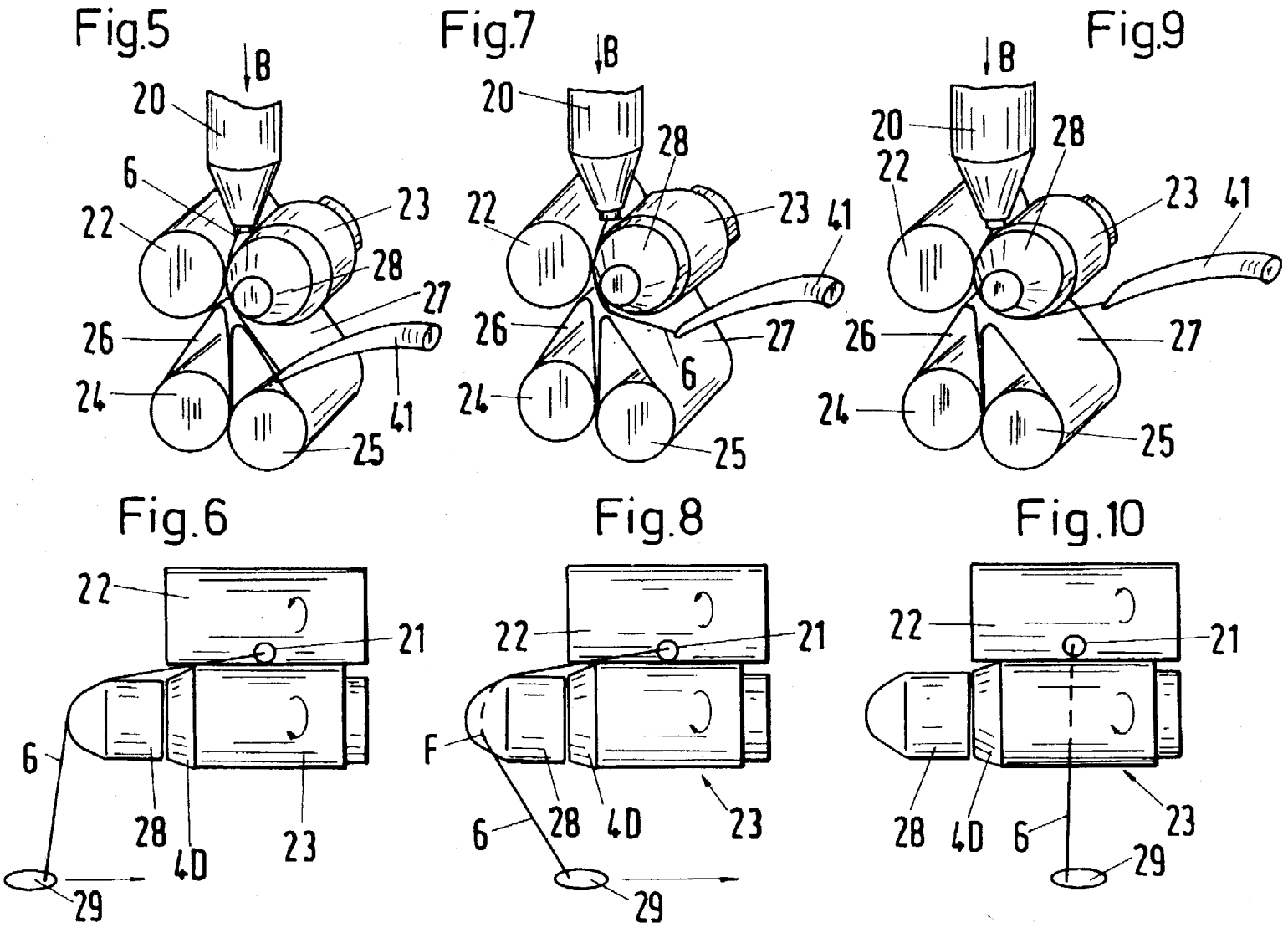
FIG. 5 schematically shows the main draft zone of the drafting arrangement of FIG. 1, in combination with a yarn handling device situated in a standby position.
FIG. 6 shows the arrangement in accordance with FIG. 5 as seen in the direction of arrow B.
FIG. 7 shows the arrangement of FIG. 5 shortly after initiation of the yarn depositing movement.
FIG. 8 shows the arrangement shown in FIG. 7 in the direction of arrow B.
FIG. 9 shows the arrangement in accordance with FIG. 5 after the conclusion of the yarn depositing movement.
FIG. 10 shows the arrangement shown in FIG. 9 as seen in the direction of arrow B.

In FIGS. 1 to 3 the same reference numerals are used for the same elements. FIG. 1 shows the injector nozzle 1 of a jet spinning machine pertaining to the output rollers 2 and 3 of an apron drafting system (not shown). The lower roller 2 of the drafting arrangement as shown on the lefthand side is a stub-like steel cylinder in this embodiment. However, it may also be a continuous steel cylinder which extends in the known manner over several spinning positions of the spinning machine.

The upper or pressure roller 3 is attached to a weighting arm (not shown). It encompasses a rigid axle 9, FIG. 3, and a cylindrical hollow body 11 which is rotatably mounted on axle 9 by means of bearings 8, 8'. Body 11 is provided with a rubber-coated cover 4.

A cone-like cap 5 is attached on axle 9 by means of a screw 10. At its free end section, cap 5 has the shape of a truncated cone, as can be seen in FIG. 3. The part of the cap which has the form of a truncated cone changes into the cylindrical part which is adjacent to roller body 11 without actually touching it. This is secured by means of a fixing element 12 of cap 5, which element is connected with axle 9 by means of screw 10. Cap 5 and axle 9 could be made from one piece.

Transition zone 5' of the conic frustrum-like surface, where it changes into the cylindrical area, is rounded off. The tapered surface of the cap could, however, be provided in its section with a rounding off, e.g. it may have a parabolic form.

It is now assumed that by depositing a yarn at the pair of rollers 2, 3 a renewed piecing process is to be carried out. Yarn section 6 has been guided back by the twist nozzle (not shown) and the injector nozzle 1. As has been described in greater detail in our German patent application No. 4223956.7 and U.S. patent application Ser. No. 07/919,876, the yarn section 6 is received by a suction nozzle 7 at a position between injector nozzle 1 and the output rollers 2 and 3. Thereafter it is guided laterally around the drafting arrangement and subsequently held in a defined standby position. At a time determined by a control mechanism the yarn section 6 is pulled into the nip of the pair of rollers 2 and 3 by the suction nozzle. In the standby position the relatively rigidly tensioned yarn section 6 is guided-onto a cone-like cap 5. Due to a movement of the suction nozzle into the intermediate space in front of the output pressure roller 3 and the upper apron of the drafting arrangement, a loop of the yarn section 6 is guided by cap 5 into the nip line of output rollers 2 and 3.

As cap 5 does not rotate with pressure roller 3, but is rigidly screwed onto its axle, abrasive stress on the yarn section 6 which might occur by the rotating output rollers 2 and 3 during the phase of the lateral excursion next to the drafting arrangement is prevented.

The larger outer diameter portion of the cone-like cap 5 has at least the same size of or it is preferably even larger than the outer diameter of the subsequent portion of the rubber coating 4 of pressure roller 3.

The arrangement allows a timed depositing of the yarn section 6, i.e., the yarn end can be guided at the right time to the site designated for the yarn connection in the yarn connecting or piecing process, without allowing a premature connection of the drafted fibers to occur in the operating drafting arrangement.

It is to be understood that the above-mentioned cap 5 is not only suitable for so-called apron drafting systems, but also for other drafting arrangements such as the certain drafting arrangements disclosed in the above-mentioned book by Wegener, page 315).

As cap 5 can be easily removed, the pressure rollers can still be easily exchanged for maintenance purposes.

A further possibility is to provide the rotating portion of pressure roller 3 (e.g. the hollow body) with a lateral cap 5. This solution, however, is preferably not taken into account because in such a case it is not possible to prevent the mentioned abrasive strain on yarn section 6, even if the cap material were highly polished. In addition, the production expenditure would rise because the pressure roller 3 with the rubber-coated cover 4 would have to have improved concentric running properties so as to prevent periodic yarn faults. Adherence to these requirements is made more difficult by the attachment of a cap.

The rubber-coated cover 4 in accordance with FIG. 2 comprises a central zone 4A with a diameter D and two end zones 4B, 4C with smaller diameters $d_1$, $d_2$. Zone 4B is adjacent to cap 5. The nip line of the pair of delivery rollers 2, 3 is formed between the roller 2 and the central zone 4A of the cover. The largest diameter portion of cap 5 can be of the same size as the diameter D of the central region 4A, i.e., it can exceed end zone 4B.

FIG. 4 schematically shows a single spinning position of a jet spinning machine (e.g., in accordance with EP 131 170 or EP 372 255). The spinning position comprises a drafting arrangement 40 with a pair of input rollers 37, a central pair of rollers 38 (which is provided with aprons) and a pair of delivery rollers 39. A condenser 35 is situated in front of the pair of input rollers 37 and forms a part of the sliver stopper in accordance with EP 353 575. The elements of FIG. 4 are only shown schematically more or less separated from one another so as to improve the recognizability of the individual components.

A yarn spinning nozzle body 20 is provided behind the drafting arrangement 40, which body may be arranged, for example, in accordance with DE 40 23 985 or EP 489 686. The yarn wind-up unit 50 comprises a friction roller 44 and a holder 46 which carries a cross-wound bobbin 48. Usually, yarn spun by nozzle body 20 is drawn off by the pair of draw-off rollers 42 and supplied to the winder unit 50 for forming a package of yarn on the bobbin.

In the arrangement shown, it is assumed that the yarn was broken during the spinning, such that it has to be pieced up again with a new sliver end. As shown, the yarn has been withdrawn from the bobbin package and has been threaded by means of a handling device (not shown fully—see, for example, EP 467 159) with a suction nozzle 41 through a pair of draw-off rollers 42 with the draw-off rollers not in contact with one another for this purpose. Instead of retrieving yarn from the bobbin package, it is possible to use an auxiliary yarn for renewed piecing which can be thrown onto a bobbin case carried by holder 46 after the successful piecing. The yarn to be pieced can be guided back by the nozzle body 20, e.g. in accordance with a method of EP 433 832, according to which the yarn end is taken up again by the suction nozzle 41.

FIGS. 5 to 10 shows a process for renewed piecing in a spinning position in accordance with FIG. 4 with a drafting arrangement and a roller in accordance with the present invention. The nozzle body is shown with reference numeral 20, the pair of delivery rollers 22, 23 and the pair of apron rollers 24, 25. The aprons are indicated with numerals 26, 27. The upper or pressure roller 23 of the pair of delivery rollers has a "conical" cap 28 in accordance with the present invention. The location of the inlet orifice of the nozzle body in the vicinity of the drafting arrangement is indicated in FIGS. 6, 8 with 10 and 21.

The location of the orifice of the suction nozzle is indicated with reference numeral 29. The suction nozzle is situated laterally from the standby position as shown in FIGS. 5, 6. The yarn section 6 extends from the nozzle body 20 laterally (as viewed from above) nearly parallel to the nip line of the pair of delivery rollers 22, 23 FIG. 6 and is guided by the conical end section of cap 28. FIGS. 6, 8 and 10 are spatially distorted with respect to the actual arrangement, because it is not possible to represent the three-dimensionality of the yarn course in these illustrations. In these Figures the cylindrical areas of cap 28 are shown schematically "extended" to the left in order to stress that there is no contact of the yarn with cover 4. The actual embodiment is shown more realistically in FIG. 3.

Cap 28 is arranged in such a way that the yarn section being guided laterally does not come into contact with any rotating part of the drafting arrangement (in this phase). At this position the yarn can be held without the yarn being abraded by the rotating rollers or without an additional twist being produced in the yarn. The drawing off of the yarn captured in the suction nozzle can be initiated already during the time when the suction tube is holding the yarn end in the standby position, namely by the pair of draw-off rollers 42 situated behind the nozzle, FIG. 4. The yarn is stretched tight by said drawing off.

FIGS. 7 and 8 show an intermediate phase in which the suction nozzle 41 is moving in a direction towards the central plane or path of sliver delivery through the drafting arrangement. A loop F, FIG. 8, is formed on cap 28. The yarn still does not touch any of the rotating parts, so that the position is still "precisely" defined. Loop F is continuously "shortened" by said drawing off. At a given time the "apex" of said yarn loop moves over the transitional zone into the nip line of the pair of delivery rollers. The loop is thereafter gradually removed out of the suction nozzle 41 by the drawing off of the yarn, so that at the end of the depositing process the yarn enters the nip line in straight alignment with the normal path of sliver delivery, FIG. 10.

In this case the transitional movement of the yarn from cap 28 to the surface of pressure roller 23 is facilitated by the end zone 4D of the cover also being formed cone-like. The smallest diameter end of the conical zone 4D can be smaller than the diameter of the cylindrical portion of cap 28. As soon as the yarn comes into contact with the cover 4 of the pressure roller, the cover exerts a conveying effect thereon. This effect arises on delivery speed as soon as the yarn is inserted into the nip line of the delivery rollers. The length or arrangement of cap 5 or 28 is selected such that for a given position of nozzle body 20 with respect to the drafting arrangement, a yarn guided by the manipulating nozzle can extend around the cap without touching any rotating part of the drafting arrangement.

FIGS. 5 to 10 show that the yarn section 6 actually only touches a portion of the conical surface, i.e., the portion shown facing roller 22. The portion of this surface which faces away from the roller 22 actually does not have any effect. For this reason this portion would not necessarily have to be provided with a yarn guiding surface. For example, it would not have to be tapered. Cap 28, however, is nevertheless preferably arranged rotationally symmetrically, because in this case it can be attached without taking any special notice of its angular position with respect to the mounting axis or the pressure roller. Furthermore, it constitutes an inexpensive solution to the problem solved by the invention.

The controlled movement of the suction nozzle 7 or 41 from a lateral position to the central plane of the drafting arrangement is preferably carried out so fast that the yarn loop F is extended the length of the gap between cap 5 or 28 and the cover 4. This serves to aid in preventing the yarn section 6 from getting caught in this gap.

FIGS. 11 to 16 illustrate three further embodiments, which show that the cap does not necessarily have to be provided on the axle of the pressure roller. The corresponding components of the embodiment described with reference to FIGS. 5 to 10 have the same reference numerals as corresponding components in FIGS. 11 to 16. Alternative components are exclusively limited to the cap and its carrier. The attachment of the cap on the carrier is not made within the pressure roller but on a surface component of the cap, which is not touched by the yarn during the depositing movement.

In the embodiments shown in FIGS. 11 and 12 cap 105 is carried by an arm 106 which is mounted on a service robot (not shown; see however EP 421 152) as an element of a handling device. Cap 105 can be delivered to pressure roller 3 during an operating process by means of said arm 106.

In order to simplify the positioning of cap 105 with respect to pressure roller 3, cap 105 can be provided with a socket 107 (FIG. 12) which receives an end part of axle 9. This, however, is not essential. The small gap S between cap 105 and cover 4 can be bridged, as was mentioned above, by the movement of suction nozzle 7 or 41. In the present embodiment cap 105 only has to be provided once for all spinning positions serviced by the service robot.

Cap 105 could be made in one piece with arm 106. However, preferably it is made separately and attached to arm 106 in the area 108 (FIG. 12), for example.

The embodiments of FIGS. 13 and 14 show a cap 115 which is carried by an arm 116. Arm 116 is attached to the weighting arm (not shown) of the drafting arrangement. The cap can either be made in one part with arm 116 or be attached thereto.

FIGS. 15 and 16 show a further embodiment which is only distinguished from the embodiment in accordance with FIGS. 13 and 14 in that carrier arm 117 is not attached to the weighting arm of the drafting arrangement, but that it is attached by means of a plate 118 to a part (not shown) of the machine frame in the vicinity of the nozzle body.

We claim:

1. A drafting arrangement for a fine spinning frame the drafting arrangement having at least one pair of input rollers, an apron drafting zone and a pair of output rollers having a nip line, characterized in that a pressure roller of the pair of output rollers is provided with a cap which is non-rotationally arranged in the drafting arrangement and which is provided with a yarn guiding surface which is suitable for guiding a yarn to the nip line of the pair of output rollers.

2. A drafting arrangement as claimed in claim 1, characterized in that the cap is carried by an element which is stationary with respect to the drafting arrangement.

3. A drafting arrangement as claimed in claim 1, characterized in that the cap is carried by an element which is movable towards the drafting arrangement in such a way that the cap is advanceable to the pressure roller.

4. A drafting arrangement as claimed in claim 1 characterized in that the cap is symmetrical.

5. A drafting arrangement as claimed in claim 4, characterized in that the cap is shaped in the form of a truncated cone having a larger diameter end mounted immediately adjacent to an end of the pressure roller.

6. A drafting arrangement as claimed in claim 5, characterized in that the the diameter of the larger diameter end of the truncated cone is no less than the diameter of the end of the pressure roller.

7. A drafting arrangement as claimed in claim 6, characterized in that the cap has an outer surface which is rounded off at its larger diameter end.

8. A renewed piecing process for a fine spinning frame, according to which a yarn is deposited between a pair of delivery rollers of a drafting arrangement, with the yarn being guided so near to the pair of delivery rollers that a yarn handling device cannot take up an standby position in front of the pair of delivery rollers without bringing the yarn into contact with a part of a delivery roller in the vicinity of the nip wherein the drafting arrangement comprises a drafting arrangement according to claim 1, the process comprising guiding the handling device to such a standby position so that the yarn touches the cap without coming into contact with the rotating parts of the rollers.

9. A method as claimed in claim 8, wherein after the yarn end is guided downstream of the drafting arrangement through a nozzle body, a yarn loop is formed between an inlet opening of the device and an inlet opening of the nozzle body by movement of the device in a back and forth direction away from and toward a central plane of the drafting arrangement.

10. The spinning machine of claim 1 wherein the cap mechanism mounted on the laterally displaced end of the one roller has an outer surface configured to a predetermined shape for guiding the yarn end laterally guided by the suction tube around the ends of the rollers into the nip line of the rollers.

11. The spinning machine of claim 10 wherein the outer surface of the cap mechanism has a surface portion facing toward the nip line, the suction tube pulling the captured yarn end around the ends of rollers into engagement with the portion of the cap surface facing the nip line, the portion of the cap surface facing the nip line guiding the yarn end into the nip line upon movement of the suction tube pulling the yarn end toward the position of sliver path delivery.

12. The spinning machine of claim 11 wherein the cap mechanism is mounted on the end of the one roller such that the cap mechanism does not rotate together with the roller.

13. The spinning machine of claim 10 wherein the cap mechanism is mounted on the end of the one roller such that the cap mechanism does not rotate together with the roller.

14. A roller for a drafting arrangement of a fine spinning frame with an axle and a roller body rotatably carried on said axle, characterized in that a cap is rigidly attached to the axle and comprises a yarn guiding surface which is suitable for guiding a yarn to a nip line formed by the roller.

15. A yarn spinning machine comprising a spinning mechanism and a drafting apparatus for continuously delivering a sliver to an inlet of the spinning mechanism wherein the sliver is spun into a yarn and the yarn is continuously withdrawn from the spinning mechanism and wound up;

the drafting apparatus comprising a pair of rotatably mounted rollers for delivering the sliver along a selected path to the inlet of the spinning mechanism; the delivery rollers having a nip line extending from a position in the selected path to the inlet laterally to an end of the rollers laterally displaced from the inlet of the spinning mechanism;

the end of one of the rollers having a cap mechanism mounted on the end of the one roller such that the cap does not rotate together with the one roller;

the cap having an outer surface for guiding a yarn end which is reversely routed through the spinning mechanism and laterally guided around the cap on the end of the one roller into the nip of the rollers upon further guiding of the reversely routed yarn end to a position upstream of the nip line position in the path to the inlet of the spinning mechanism.

16. The spinning machine of claim 15 wherein the cap mechanism is rigidly attached to an axle of the one roller.

17. The spinning machine of claim 16 wherein the outer surface of the cap mechanism has a symmetric configuration around the axle to which the cap is attached.

18. The spinning machine of claim 15 wherein the outer surface of the cap has an at least partially conical configuration having an axis coincidental with a rotation axis of the one roller.

19. The spinning machine of claim 18 wherein the cap is mounted on the end of the one roller such that a widest diameter end of the at least partially conical outer surface is immediately adjacent an end of the one roller and has a diameter equal to or greater than the diameter of the end of the one roller to which the cap is attached.

20. The spinning machine of claim 19 wherein the widest diameter end of the conical outer surface of the cap is rounded off.

* * * * *